US009050826B2

(12) United States Patent
Hirose et al.

(10) Patent No.: US 9,050,826 B2
(45) Date of Patent: Jun. 9, 2015

(54) THERMAL HEAD AND THERMAL PRINTER EQUIPPED WITH THE SAME

(71) Applicant: KYOCERA Corporation, Kyoto-shi, Kyoto (JP)

(72) Inventors: Shouji Hirose, Kyoto (JP); Yoshiyuki Kondou, Kyoto (JP); Yuuji Kashima, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/376,485

(22) PCT Filed: Jan. 31, 2013

(86) PCT No.: PCT/JP2013/052155

§ 371 (c)(1),
(2) Date: Aug. 4, 2014

(87) PCT Pub. No.: WO2013/129020

PCT Pub. Date: Sep. 6, 2013

(65) Prior Publication Data

US 2015/0009270 A1 Jan. 8, 2015

(30) Foreign Application Priority Data

Feb. 28, 2012 (JP) ..... 2012-041729

(51) Int. Cl.
*B41J 2/335* (2006.01)

(52) U.S. Cl.
CPC ..... *B41J 2/3353* (2013.01); *B41J 2/3351* (2013.01); *B41J 2/33515* (2013.01); *B41J 2/33525* (2013.01); *B41J 2/33535* (2013.01); *B41J 2/3354* (2013.01); *B41J 2/33545* (2013.01); *B41J 2/3355* (2013.01); *B41J 2/3357* (2013.01)

(58) Field of Classification Search
CPC ..... B41J 2/3351; B41J 2/3353; B41J 2/3354; B41J 2/33515; B41J 2/33525; B41J 2/33535
See application file for complete search history.

(56) References Cited

U.S. PATENT DOCUMENTS

| | | | | |
|---|---|---|---|---|
| 6,184,913 | B1 * | 2/2001 | Nagano et al. | 347/203 |
| 2004/0046857 | A1 * | 3/2004 | Sato et al. | 347/203 |
| 2010/0085412 | A1 * | 4/2010 | Kanei et al. | 347/203 |

FOREIGN PATENT DOCUMENTS

| | | | |
|---|---|---|---|
| JP | 60-150046 | U | 10/1985 |
| JP | 05-270029 | A | 10/1993 |
| JP | 11-034376 | A | 2/1999 |
| JP | 2004-050507 | A | 2/2004 |

OTHER PUBLICATIONS

International Search Report, PCT/JP2013/052155, Feb. 28, 2013, 1 pg.

* cited by examiner

*Primary Examiner* — Sarah Al Hashimi
(74) *Attorney, Agent, or Firm* — Volpe and Koenig, P.C.

(57) ABSTRACT

A thermal head includes: a substrate; a heat storage layer disposed on the substrate; a heat-generating section disposed on the heat storage layer; an electrode electrically connected to the heat-generating section; a protection layer which coats the heat-generating section and a part of the electrode; and a first coating layer which coats a part of the protection layer and is disposed downstream in a transportation direction of a recording medium, with respect to the heat-generating section, the first coating layer including a first protrusion protruding towards a recording medium side, an end on a heat-generating section side of the first coating layer being positioned between the first protrusion and the heat-generating section, and the end on the heat-generating section side of the first coating layer being positioned in a range of L/2 from the heat-generating section, in which L is a distance between the heat-generating section and the first protrusion.

20 Claims, 11 Drawing Sheets

( a )

( b )

(a)

(b)

(a)

(b)

(a)

(b)

THERMAL HEAD AND THERMAL PRINTER EQUIPPED WITH THE SAME

FIELD OF INVENTION

The present invention relates to a thermal head and a thermal printer equipped with the same.

BACKGROUND

In the related art, various thermal heads have been proposed as a printing device such as a facsimile or a video printer. For example, a thermal head disclosed in Patent Literature 1 includes a substrate, a heat storage layer provided on the substrate, a heat-generating section provided on the heat storage layer, an electrode electrically connected to the heat-generating section, and a coating layer which coats a part of the electrode and is disposed downstream in a transportation direction of a recording medium, with respect to the heat-generating section.

CITATION LIST

Patent Literature

Patent Literature 1: Japanese Unexamined Patent Publication JP-A 2004-50507

SUMMARY

Technical Problem

Meanwhile, in a conventional thermal head, a coating layer includes a protrusion. Accordingly, when printing is performed on a recording medium using this thermal head, the recording medium comes in contact with the protrusion, and thus print scratches or blurring may be generated on the recording medium.

Solution to Problem

A thermal head according to one embodiment of the invention includes: a substrate; a heat storage layer disposed on the substrate; a heat-generating section disposed on the heat storage layer; an electrode electrically connected to the heat-generating section; a protection layer which coats the heat-generating section and a part of the electrode; and a first coating layer which coats a part of the protection layer and is disposed downstream in a transportation direction of a recording medium, with respect to the heat-generating section. The first coating layer includes a first protrusion protruding towards a recording medium side, an end on a heat-generating section side of the first coating layer is positioned between the first protrusion and the heat-generating section, and the end on the heat-generating section side of the first coating layer is positioned in a range of L/2 from the heat-generating section, in which L is a distance between the heat-generating section and the first protrusion.

A thermal printer in accordance with one embodiment of the invention includes: the thermal head as described above; a conveyance mechanism which conveys a recording medium onto the heat-generating section; and a platen roller which presses the recording medium onto the heat-generating section.

Advantageous Effects of Invention

According to the invention, it is possible to reduce a possibility of print scratches or blurring being generated on the recording medium.

DETAILED DESCRIPTION OF THE PREFERRED EMBODIMENTS

First Embodiment

Hereinafter, a thermal head X1 according to a first embodiment will be described with reference to the drawings. As shown in FIGS. 1 to 4, the thermal head X1 according to the embodiment includes a radiator 1, a head base body 3 which is disposed on the radiator 1, and a flexible printed circuit 5 (hereinafter, referred to as a FPC 5) which is connected to the head base body 3.

Figure 1:
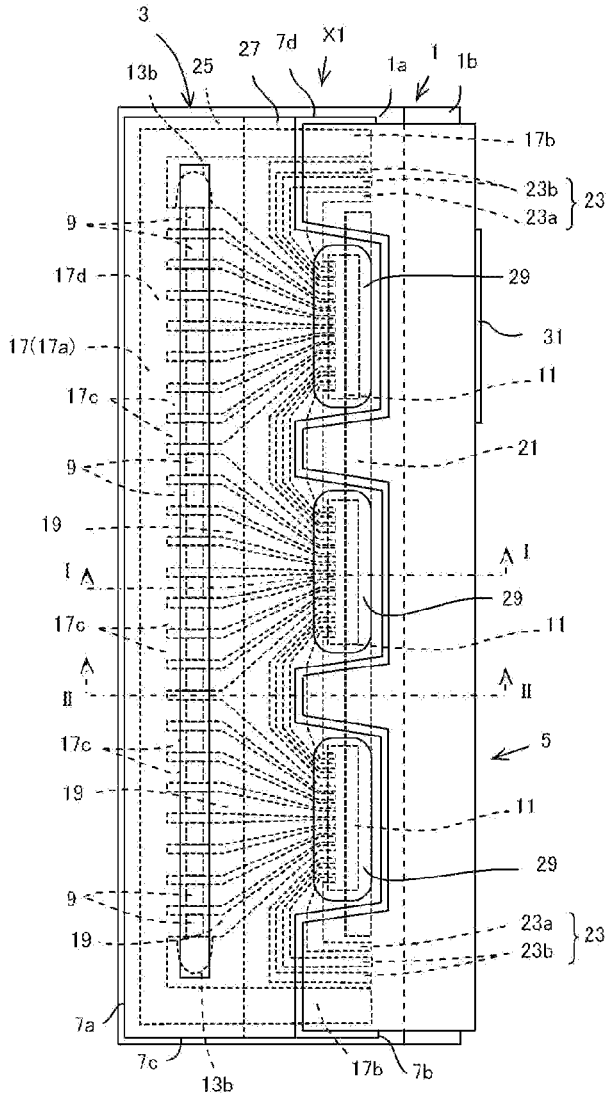
FIG. 1 is a plan view showing one embodiment of a thermal head of the invention.
Figure 2:
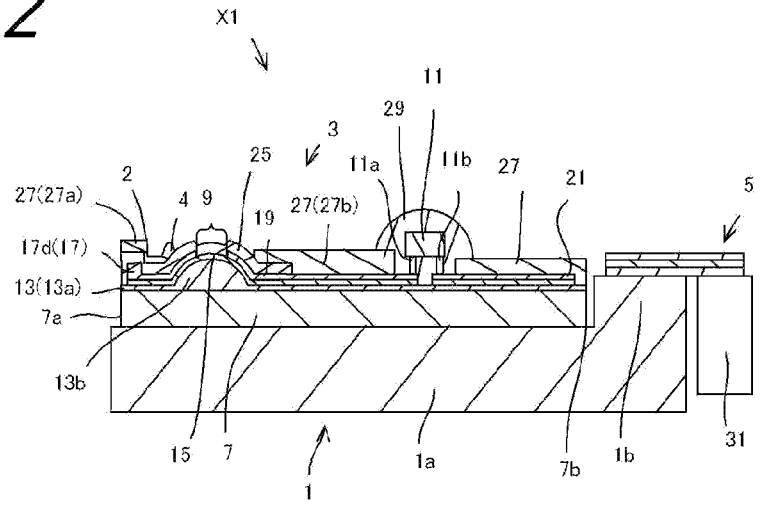
FIG. 2 is a cross-sectional view of a thermal head taken along the line I-I in FIG. 1.

The radiator 1 is made of a metal material such as copper or aluminum, for example, and includes a base portion 1*a* which has a rectangular shape and a protrusion 1*b* which extends along one long side of the base portion 1*a*, in a plan view. As shown in FIG. 2, the head base body 3 is bonded to an upper surface of the base portion 1*a* excluding the protrusion 1*b*, with a double-sided tape or an adhesive (not shown). In addition, the FPC 5 is bonded to the upper portion of the protrusion 1*b* with a double-sided tape or an adhesive (not shown). The radiator 1 has a function of radiating some heat not contributing to printing, from heat generated in a heat-generating section 9 of the head base body 3 as will be described later.

As shown in FIGS. 1 to 4 and FIGS. 6 to 8, the head base body 3 includes a substrate 7 which has a rectangular shape in a plan view, the plurality of heat-generating sections 9 which are arranged on the substrate 7 along a longitudinal direction of the substrate 7, and a plurality of driving ICs 11 which are disposed on the substrate 7 in a line along an arrangement direction of the heat-generating sections 9 (hereinafter, referred to as an arrangement direction).

The substrate 7 is made of an electrically insulating material such as alumina ceramics, a semiconductor material such as single-crystal silicon, or the like.

Figure 3:
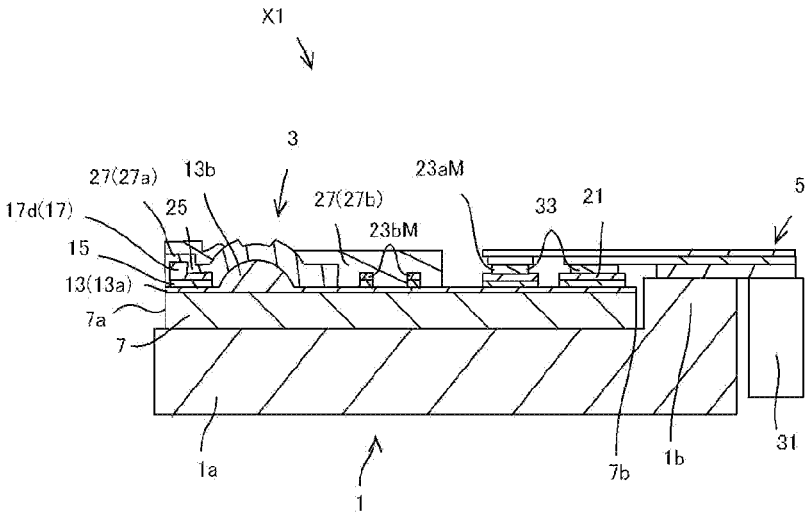
FIG. 3 is a cross-sectional view of a thermal head taken along the line II-II in FIG. 1.
Figure 4:
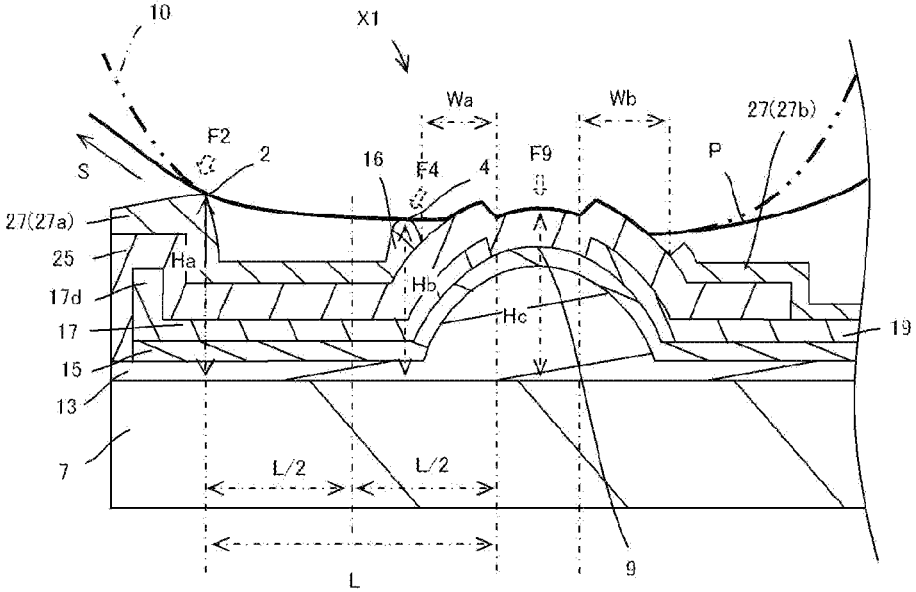
FIG. 4 is an enlarged cross-sectional view showing an enlarged vicinity of a heat-generating section of a thermal head of FIG. 2.

As shown in FIGS. 2 to 4, a heat storage layer 13 is formed on the upper surface of the substrate 7. The heat storage layer 13 includes a base layer 13*a* and a swollen portion 13*b*. The base layer 13*a* is formed over the entire upper surface of the substrate 7. The swollen portion 13*b* is partially swollen from the base layer 13*a* and extends along an arrangement direction of the plurality of heat-generating sections in a belt shape, and a sectional shape thereof is a substantial semi-elliptical shape. The swollen portion 13*b* functions so as to successfully press a recording medium P to be printed against a protection layer 25 formed on the heat-generating section 9.

The heat storage layer 13 can be made of glass having low thermal conductivity, for example, and temporarily stores some heat generated in the heat-generating section 9. Accordingly, the heat storage layer functions so as to shorten the time necessary for increasing a temperature of the heat-generating section 9 and to increase thermal responsiveness of the thermal head X1. The glass for forming the heat storage layer 13, for example, is formed by applying predetermined glass paste obtained by incorporating a suitable organic solvent to glass powder on the upper surface of the substrate 7 by conventionally well-known screen printing and by firing this at a high temperature.

As the glass for forming the heat storage layer 13, a material containing SiO2, Al2O3, CaO, and BaO, a material containing SiO2, Al2O3, and PbO, a material containing SiO2, Al2O3, and BaO, or a material containing SiO2, B2O3, PbO, Al2O3, CaO, and MgO is used, for example.

Figure 6:
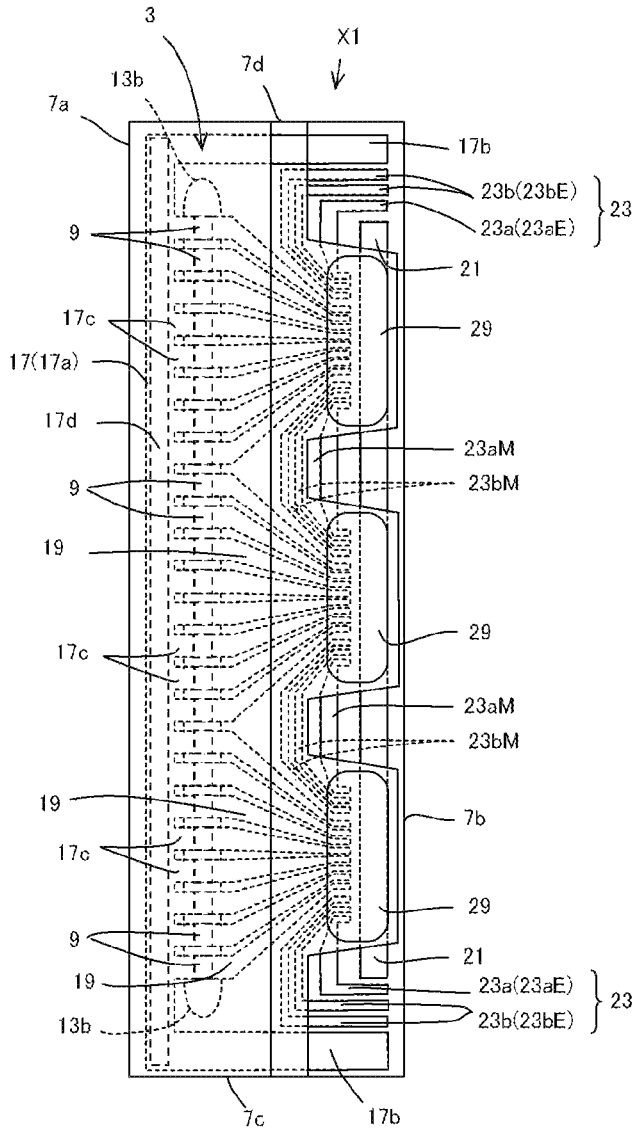
FIG. 6 is a plan view of a head base body configuring a thermal head shown in FIG. 1.

An electrical resistance layer 15 is provided on the upper surface of the heat storage layer 13. The electrical resistance layer 15 is interposed between the heat storage layer 13, and a common electrode 17, an individual electrode 19, a ground electrode 21, and an IC control electrode 23 which will be described later. As shown in FIG. 6, the electrical resistance layer 15 includes an area having the same shape as those of the individual electrode 19, the common electrode 17, the ground electrode 21, and the IC control electrode 23, in a plan view (hereinafter, referred to as an interposed area). In addition, the electrical resistance layer 15 includes a plurality of areas which are exposed from between the individual electrode 19 and the common electrode 17 (hereinafter, referred to as exposed areas).

Figure 7:
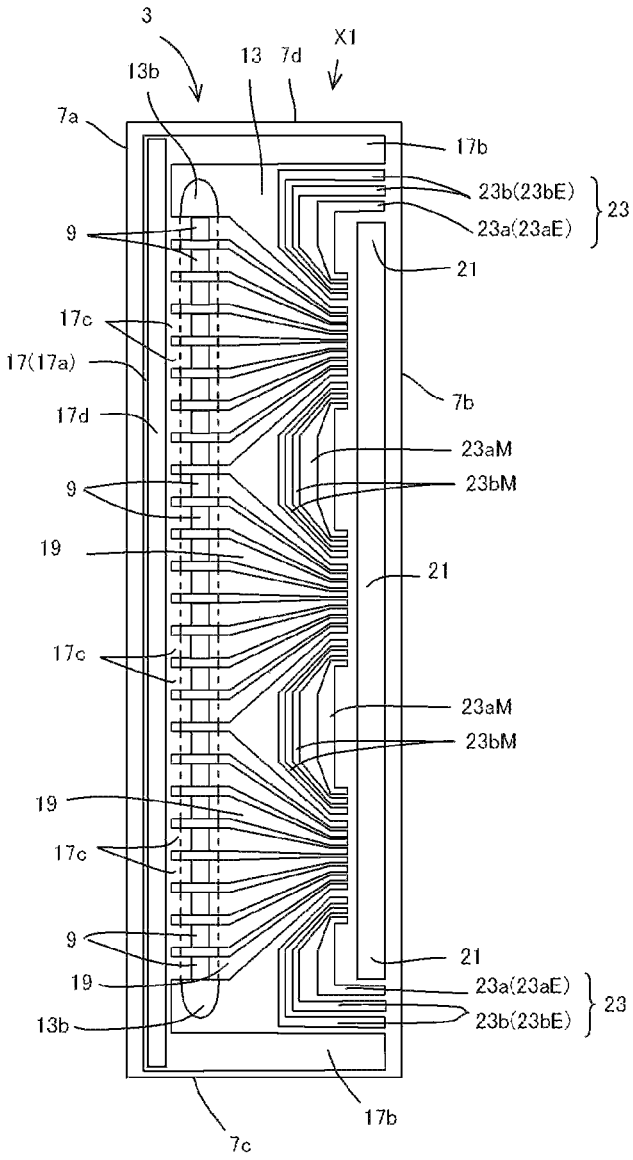
FIG. 7 is a plan view of a head base body of FIG. 6 in which a protection layer, a coating layer, a driving IC, and a coating member are not shown.

Each exposed area of the electrical resistance layer 15 forms the heat-generating section 9 described above. As shown in FIGS. 2 and 7, the plurality of heat-generating sections 9 are arranged on the swollen portion 13*b* of the heat storage layer 13 in a row. For convenience of description, the plurality of heat-generating sections 9 are simply shown in FIGS. 1, 6 and 7, but the plurality of heat-generating sections are disposed at a density of 180 dpi (dot per inch) to 2400 dpi, for example.

The electrical resistance layer 15 is, for example, formed with a material having relatively high electrical resistance such as TaN-based, TaSiO-based, TaSiNO-based, TiSiO-based, TiSiCO-based, or NbSiO-based material. Accordingly, when a voltage is applied between the common electrode 17 and the individual electrode 19 and current is supplied to the heat-generating section 9, the heat-generating section 9 generates heat by Joule heating.

As shown in FIGS. 1 to 4 and FIGS. 5 to 8, the common electrode 17, the individual electrode 19, the ground electrode 21, and the IC control electrode 23 are provided on the upper surface of the interposed area. The common electrode 17, the individual electrode 19, the ground electrode 21, and the IC control electrode 23 are made of a material having conductivity, and are, for example, made of any one kind of metal among aluminum, gold, silver, and copper, or an alloy thereof.

As shown in FIG. 7, the common electrode 17 includes a main wiring portion 17*a*, auxiliary wiring portions 17*b*, and lead portions 17*c*. The main wiring portion 17*a* extends along one long side 7*a* of the substrate 7, and as shown in FIG. 4, a thick portion 17*d* having a greater thickness than that of the other portions of the common electrode 17 is formed. Accordingly, it is possible to reduce wiring resistance of the common electrode 17. The auxiliary wiring portions 17*b* extend along one short side 7*c* and the other short side 7*d* of the substrate 7, respectively, and each one end thereof is connected to the main wiring portion 17*a*. Each of the lead portions 17*c* extends towards each heat-generating section 9 from the main wiring portion 17*a*.

Figure 8:
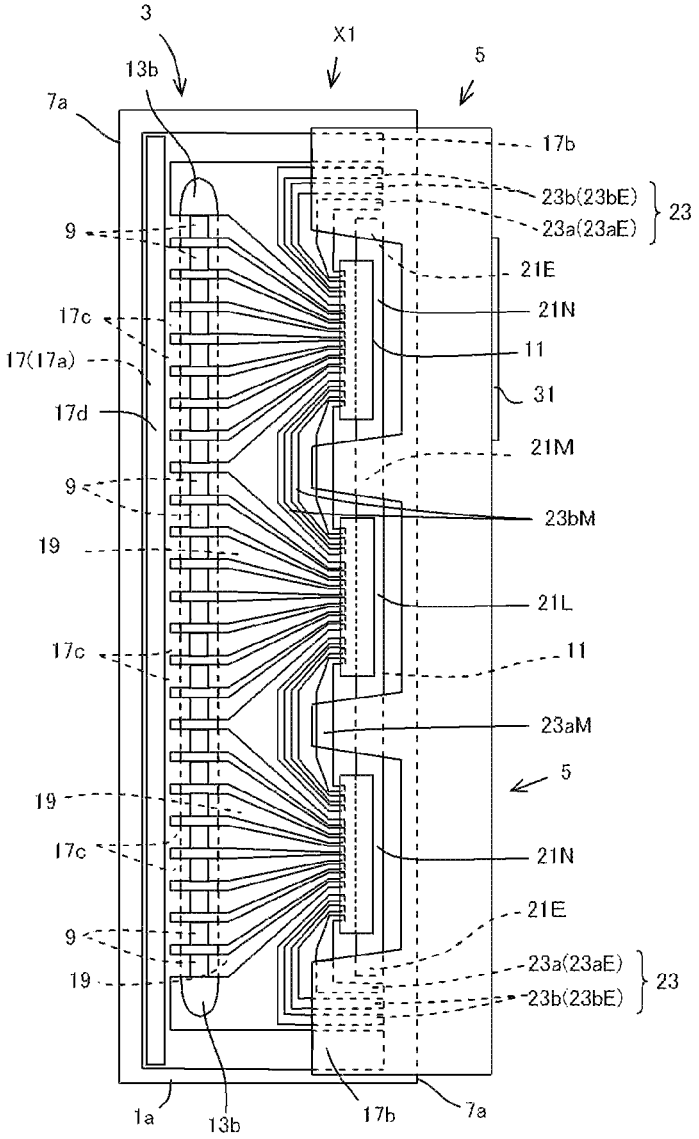
FIG. 8 is a plan view showing a state in which an external substrate is connected to a head base body in which a protection layer, a coating layer, and a coating member are not shown.

As shown in FIG. 8, each of the other ends of the auxiliary wiring portion 17*b* is connected to the FPC 5, and each of tip portions of the lead portions 17*c* is connected to the heat-generating section 9. Accordingly, the FPC 5 and the heat-generating section 9 are electrically connected to each other.

As shown in FIGS. 2 and 8, the individual electrode 19 extends between each heat-generating section 9 and the driving IC 11 and electrically connects each heat-generating section 9 and the driving IC 11 to each other. The individual electrode 19 divides the plurality of heat-generating sections 9 into a plurality of groups, and electrically connects the heat-generating sections 9 of each group to the driving IC 11 provided corresponding to each group.

As shown in FIG. 7, the ground electrode 21 extends along the arrangement direction, in the vicinity of the other long side 7*b* of the substrate 7 in a belt shape. As shown in FIGS. 3 and 8, the FPC 5 and the driving IC 11 are connected to the upper portion of the ground electrode 21. In detail, as shown in FIG. 8, the FPC 5 is connected to end areas 21E positioned in one end and the other end of the ground electrode 21. In addition, the FPC 5 is connected to first intermediate areas 21M of the ground electrode 21 positioned between adjacent driving ICs 11.

Each driving IC 11 is connected to a second intermediate area 21N between the end area 21E and the first intermediate area 21M of the ground electrode 21. In addition, each driving IC 11 is connected to a third intermediate area 21L between adjacent first intermediate areas 21M. Accordingly, the driving ICs 11 and the FPC 5 are electrically connected to each other.

As shown in FIG. 8, each driving IC 11 is disposed so as to correspond to each group of the plurality of heat-generating sections 9, and is connected to one end of the individual electrode 19 and the ground electrode 21. The driving IC 11 is a component for controlling an electrical connection state of each heat-generating section 9, and includes a plurality of switching elements therein, as will be described later. The internal electrical connection state changes, by switching of the switching elements. A first connection terminal 11*a* connected to the internal switching element (not shown) of each driving IC 11 is connected to the individual electrode 19. In addition, a second connection terminal 11*b* connected to the switching element of each driving IC 11 is connected to the ground electrode 21.

Although not shown, the plurality of first connection terminals 11*a* connected to the individual electrodes 19 and the plurality of second connection terminals 11*b* connected to the ground electrode 21 are provided so as to correspond to each individual electrode 19. The plurality of first connection terminals 11*a* are individually connected to each individual electrode 19. In addition, the plurality of second connection terminals 11*b* are connected to the ground electrode 21 in common.

The IC control electrode 23 is a component for controlling the driving IC 11, and includes an IC power electrode 23*a* and an IC signal electrode 23*b*, as shown in FIGS. 6 and 7. Each IC power electrode 23*a* includes an end power electrode portion 23*a*E and an intermediate power electrode portion 23*a*M. The end power electrode portions 23*a*E are disposed in both ends of the substrate 7 in the longitudinal direction and in the vicinity of the other long side 7*b* of the substrate 7. The intermediate power electrode portion 23*a*M is disposed between adjacent driving ICs 11, and electrically connects the adjacent driving ICs 11 to each other.

As shown in FIG. 8, one end of the end power electrode portion 23*a*E is disposed in a disposition area of the driving IC 11, and the other end thereof is disposed in the vicinity of the other long side 7*b* of the substrate 7, so as to surround the periphery of the ground electrode 21. One end of the end power electrode portion 23*a*E is connected to the driving IC 11, and the other end thereof is connected to the FPC 5. Accordingly, the driving ICs 11 and the FPC 5 are electrically connected to each other.

In addition, the intermediate power electrode portion 23*a*M extends along the ground electrode 21, the one end thereof is disposed in the disposition area of one of the adjacent driving ICs 11, and the other end thereof is disposed in the disposition area of the other one of the adjacent driving ICs 11. One end of the intermediate power electrode portion 23*a*M is connected to one of adjacent driving ICs 11, the other end thereof is connected to the other one of the adjacent driving ICs 11, and an intermediate portion thereof is connected to the FPC 5 (see FIG. 3). Accordingly, the driving ICs 11 and the FPC 5 are electrically connected to each other.

The end power electrode portion 23*a*E and the intermediate power electrode portion 23*a*M are electrically connected to each other inside the driving IC 11 to which both electrode portions are connected. In addition, both adjacent intermediate power electrode portions 23*a*M are electrically connected to each other inside the driving IC 11 to which both adjacent intermediate power electrode portions are connected.

As described above, by connecting the IC power electrode 23*a* to each driving IC 11, the IC power electrode 23*a* electrically connects each driving IC 11 and the FPC 5 to each other. Therefore, as will be described later, in the thermal head X1, it is possible to supply a current to each driving IC 11 from the FPC 5 through the end power electrode portions 23*a*E and the intermediate power electrode portions 23*a*M.

As shown in FIGS. 7 and 8, each IC signal electrode 23*b* includes an end signal electrode portion 23*b*E and an intermediate signal electrode portion 23*b*M. The end signal electrode portions 23*b*E are disposed in both ends of the substrate 7 in the longitudinal direction and in the vicinity of the other long side 7*b* of the substrate 7. In addition, the intermediate signal electrode portion 23*b*M is disposed between adjacent driving ICs 11.

As shown in FIG. 8, in the same manner as the end power electrode portion 23*a*E, one end of the end signal electrode portion 23*b*E is disposed in the disposition area of the driving IC 11, and the other end thereof is disposed in the vicinity of the right long side of the substrate 7, so as to surround the periphery of the ground electrode 21. One end of the end signal electrode portion 23*b*E is connected to the driving IC 11, and the other end thereof is connected to the FPC 5.

One end of the intermediate signal electrode portion 23*b*M is disposed in the disposition area of one of adjacent driving ICs 11, and other end thereof is disposed in the disposition area of the other one of the adjacent driving ICs 11 so as to surround the periphery of the intermediate power electrode portion 23*a*M. One end of the intermediate signal electrode portion 23*b*M is connected to one of adjacent driving ICs 11, and the other end thereof is connected to the other one of the adjacent driving ICs 11.

The end signal electrode portion 23*b*E and the intermediate signal electrode portion 23*b*M are electrically connected to each other inside the driving IC 11 to which both electrode portions are connected. In addition, both adjacent intermediate signal electrode portions 23*b*M are electrically connected to each other inside the driving IC to which both adjacent intermediate signal electrode portions are connected.

As described above, by connecting the IC signal electrode 23*b* to each driving IC 11, the IC signal electrode 23*b* electrically connects each driving IC 11 and the FPC 5 to each other. Accordingly, as will be described later, a control signal which is transmitted to the driving IC 11 from the FPC 5 through the end signal electrode portion 23*b*E is further transmitted to the adjacent driving ICs 11 through the intermediate signal electrode portion 23*b*M.

The electrical resistance layer 15, the common electrode 17, the individual electrode 19, the ground electrode 21, and the IC control electrode 23 described above are, for example, formed by sequentially laminating each material layer configuring each component on the heat storage layer 13, for example, by a conventionally well-known thin film formation technology such as a sputtering method, and processing the laminated body in a predetermined pattern by using a conventionally well-known photolithographic technology or etching technology. In addition, the thick portion 17*d* can be formed by forming common electrode 17 using the method described above and applying Ag paste thereon and firing the Ag paste using a thick film formation technology such as a screening printing method. A thickness of the common electrode 17, the individual electrode 19, the ground electrode 21, and the IC control electrode 23 can be set to 0.4 μm to 2.0 μm, and a thickness of the thick portion 17*d* of the common electrode 17 can be set to 5 μm to 40 μm.

As shown in FIGS. 2 to 4, the protection layer 25 which coats the heat-generating section 9, a part of the common electrode 17, and a part of the individual electrode 19 are formed on the heat storage layer 13 formed on the upper surface of the substrate 7. In the example shown in the drawings, the protection layer 25 is formed along the arrangement direction, and is provided so as to coat an approximately left half area of the upper surface of the heat storage layer 13 in a plan view.

The protection layer 25 coats the heat-generating section 9, a part of the common electrode 17, and a part of the individual electrode 19, and therefore it is possible to reduce a possibility of oxidation of each coated member due to a reaction with oxygen. In addition, it is possible to reduce a possibility of corrosion of the heat-generating section 9, the common electrode 17, and the individual electrode 19 caused by adhesion of moisture or dust contained in the atmosphere.

The protection layer 25 can be made of, for example, Si3N4, SiON, SiC, glass, SiCN, or the like. The protection layer 25 may contain another element such as Al or Y. In addition, the protection layer 25 may be formed as a single layer or may be formed by laminating a plurality of layers having different compositions.

As shown in FIGS. 1 to 4 and 6, a coating layer 27 which partially coats the common electrode 17, the individual electrode 19, the IC control electrode 23, and the ground electrode 21 is provided on the heat storage layer 13 formed on the upper surface of the substrate 7. In the example shown in the drawings, the coating layer 27 is provided so as to partially coat an approximately right half area of the upper surface of the heat storage layer 13. The coating layer 27 is a component for protecting the common electrode 17, the individual electrode 19, the IC control electrode 23 and the ground electrode 21, which are coated, from oxidation caused by contact with the atmosphere, or corrosion caused by adhesion of moisture or the like contained in the atmosphere. The coating layer 27 is formed so as to overlap the end of the protection layer 25, in order to more reliably protect the common electrode 17, the individual electrode 19 and the IC control electrode 23. The coating layer 27, for example, can be formed with a resin material such as an epoxy resin or a polyimide resin. In addition, the coating layer 27 can be formed by using a thick film formation technology such as a screen printing method, for example.

An opening portion (not shown) for exposing the end of the individual electrode 19, and the ends of the second intermediate area 21N and the third intermediate area 21L of the ground electrode 21 and the IC control electrode 23 for connection of the driving IC 11 is formed on the coating layer 27, and the wires are connected to the driving IC 11 through the opening portion. In addition, each driving IC 11 is coated and sealed with a coating member 29 made of a resin such as an epoxy resin or a silicone resin, in a state of being connected to the individual electrode 19, the ground electrode 21 and the IC control electrode 23, in order to protect the driving IC 11 itself and to protect connection portions of the driving IC 11 and the wires.

As shown in FIG. 8, the FPC 5 is connected to the common electrode 17, the ground electrode 21 and the IC control electrode 23. The FPC 5 is a well-known component in which a plurality of printed wires are wired inside an insulating resin layer, and each printed wire is electrically connected to an external power device or control device (not shown) through a connector 31 (see FIGS. 1 and 8).

In detail, printed wires formed in the FPC 5 are connected to the end of the auxiliary wiring portions 17*b* of the common electrode 17, the end of the ground electrode 21, and the end of the IC control electrode 23, respectively by solder 33 (see FIG. 3).

Figure 5:
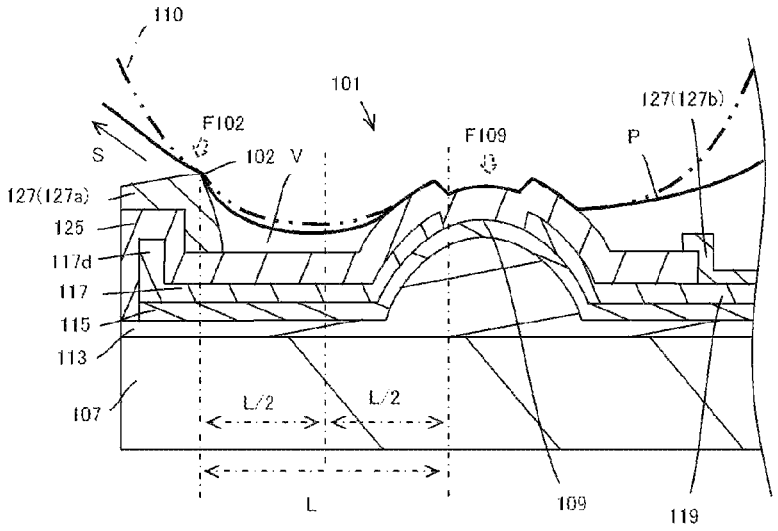
FIG. 5 is an enlarged cross-sectional view of a conventional thermal head corresponding to FIG. 4.

Hereinafter, the coating layer 27 will be described in detail with reference to FIGS. 4 and 5. FIGS. 4 and 5 schematically show an aspect of transportation of the recording medium P when performing printing, and show a platen roller 10 with a dashed-two dotted line. Stress occurring in the thermal head X1 is virtually shown with a dashed arrow. In addition, the drawings show an example of the thermal head X1 in which a second protrusion 4 is provided on an end 16 of a first coating layer 27*a*. FIG. 5 shows a conventional thermal head X101.

The coating layer 27 includes the first coating layer 27*a* which is provided downstream in a transportation direction S of the recording medium P (hereinafter, referred to as a transportation direction S) with respect to the heat-generating section 9, and a second coating layer 27*b* which is provided upstream in the transportation direction S with respect to the heat-generating section 9. The first coating layer 27*a* is provided on the end on one long side 7*a* side of the substrate 7, from the upper portion of the heat storage layer 13 to the common electrode 17. The second coating layer 27*b* is provided so as to coat a part of the individual electrode 19 and a part of the IC control electrode 23 from the heat storage layer 13.

The first coating layer 27*a* includes a first protrusion 2 which is provided on the thick portion 17*d* of the common electrode 17, and an end 16 which is disposed between the first protrusion 2 and the heat-generating section 9. In addition, the first coating layer 27*a* includes the second protrusion 4 on the end 16. The second protrusion 4 is positioned on the heat-generating section 9 side with respect to the first protrusion 2. In addition, in the embodiment, the end 16 on the heat-generating section 9 side of the first coating layer 27*a* indicates an area within 50 to 250 μm from the edge on the heat-generating section 9 side of the first coating layer 27*a*. That is, the end on the heat-generating section 9 side of the first coating layer 27*a* is an area corresponding to 20% of a length of the first coating layer 27*a* in the transportation direction S from the edge on the heat-generating section 9 side of the first coating layer 27*a* in a plan view. The second protrusion 4 is a part protruding towards the recording medium from the end 16.

In the thermal head X1, the end 16 of the first coating layer 27*a* is disposed between the first coating layer 27*a* and the heat-generating section 9. The end 16 of the first coating layer 27*a* is positioned in a range of L/2 from the heat-generating section 9, in which L is a distance between the heat-generating section 9 and the first protrusion 2. A distance between the heat-generating section 9 and the first protrusion 2 is a distance from the edge on the first coating layer 27*a* side of the heat-generating section 9 to an apex of the first protrusion 2.

The thermal head X101 shown in FIG. 5 is a conventional thermal head in which the second protrusion 4 is not provided. In the thermal head X101, a platen roller 110 is controlled so as to press the recording medium P to a heat-generating section 109 with stress F109, and the printing is performed. However, as shown in FIG. 5, a void V in which a first coating layer 127*a* does not exist is generated between a first protrusion 102 and the heat-generating section 109, and the platen roller 110 is deformed so that a part thereof infiltrates between the first protrusion 102 and the heat-generating section 109. As a result, the stress F109 on the heat-generating section 109 decreases and stress F102 on the first protrusion 102 increases.

Accordingly, image quality of the printing of the thermal head X101 may be decreased, and the image printed on the heat-generating section 109 may be strongly pressed against the first protrusion 102 to cause a print scratch generated by scratching a printed image or blurring due to blurring a printed image.

With respect to this, in the thermal head X1, the end 16 of the first coating layer 27*a* is positioned in a range of L/2 from the heat-generating section 9, in which L is the distance between the heat-generating section 9 and the first protrusion 2, and therefore it is possible to reduce an amount of the platen roller 10 infiltrating between the first protrusion 2 and the heat-generating section 9, and it is possible to reduce deformation of the platen roller 10. Thus, it is possible to reduce a possibility of a decrease of stress F9 occurring on the protection layer 25 on the heat-generating section 9, and to reduce a possibility of a decrease in image quality. In addition, since the contact of the platen roller with the first protrusion 2 is reduced, it is possible to reduce a possibility of print scratches or blurring generated in the printing of the thermal head X1.

In particular, when the thermal head X1 includes the second protrusion 4 on the end 16 of the first coating layer 27*a*, it is possible to further reduce a deformation amount of the platen roller 10, and a possibility of generation of print scratches or blurring is easily reduced.

Stress F2 occurring on the first protrusion 2, stress F4 occurring on the end 16, and the stress F9 occurring on the protection layer 25 positioned on the heat-generating section 9, occur in a direction perpendicular to contact surfaces of the recording medium P which come in contact with the first protrusion 2, the end 16, and the protection layer 25 positioned on the heat-generating section 9. Forces F2', F4', and F9' (not shown) occurring due to reaction against the stress F2, F4, and F9 occur in a reverse direction of the stress F2, F4, and F9, and these forces are referred to as forces occurring due to reaction F2', F4', and F9', hereinafter.

As shown in FIG. 5, since the first protrusion 102 comes in contact with the recording medium P, pressure occurs on the first protrusion 102. Accordingly, stress may occur inside the first protrusion 102 to damage the first protrusion 102. In addition, since the first protrusion 102 comes in contact with the recording medium P, tensile stress occurs in the transportation direction, in addition to compressive stress occurring towards the first protrusion 102, and thus the first protrusion 102 may be separated from the coating layer and the thermal head may be damaged.

With respect to this, in the thermal head X1, the second protrusion 4 is included between the first protrusion 2 and the heat-generating section 9, and thus the recording medium P comes in contact with both the first protrusion 2 and the second protrusion 4. Accordingly, the recording medium P comes in contact with at least two portions which are the first protrusion 2 and the second protrusion 4 of the coating layer 27, and therefore it is possible to reduce the stress F2 occurring on the first protrusion 2. That is, it is possible to disperse the stress F2 occurring on the first protrusion 2 by the force occurring due to reaction F4' (not shown) occurring on the second protrusion 4. Therefore, it is possible to reduce a possibility of the damage of the coating layer 27.

After the recording medium P comes in contact with the first protrusion 2, the recording medium is separated from the first coating layer 27*a*, and the first protrusion 2 has a function of guiding the recording medium P. In the thermal head X1, it is possible to apply the forces occurring due to reaction F2' and F4' to the recording medium P from the thermal head X1 in at least two portions which are the first protrusion 2 and the second protrusion 4, and it is possible to further separate the recording medium P from the thermal head X1, compared to a case of guiding the recording medium P only by the first protrusion 2.

In the second protrusion 4, since the stress F4 is applied to the recording medium P so as to release the stress F2 occurring on the first protrusion 2, it is possible to reduce the stress F2 occurring on the first protrusion 2. Therefore, it is possible to reduce a possibility that an image printed above the heat-generating section 9 is strongly pressed against the first protrusion 2, and it is possible to reduce a possibility of generation of print scratches or blurring. In addition, since the recording medium P receives the force occurring due to reaction F4' from the second protrusion 4, it is possible to efficiently release the recording medium P from the first coating layer 27*a* on the downstream side of the second protrusion 4 in the transportation direction S.

In the thermal head X1, the first protrusion 2 is provided on the thick portion 17*d*. Accordingly, the thick portion 17*d* is formed on the common electrode 17 to perform the print formation of the first coating layer 27*a*, and thus to form the first protrusion 2, and therefore it is possible to simply provide the first protrusion 2.

In addition, it is preferable that a surface roughness of the first protrusion 2 is larger than a surface roughness of the end 16. Since the surface roughness of the first protrusion 2 is larger than the surface roughness of the end 16, it is possible to increase contact points of the recording medium P and the first protrusion 2 on the first protrusion 2 where great stress F2 occurs, and it is possible to disperse the stress F2 occurring on the first protrusion 2. In order to have a surface roughness of the first protrusion 2 which is larger than the surface roughness of the end 16, the resin to be the first coating layer 27*a* is applied onto the protection layer 25, and dried and cured, for example. After that, the surface of the first coating layer 27*a* on the end 16 may be filed to process the surface coarsely. In addition, the surface of the first coating layer 27*a* on the end 16 may be chemically processed.

As shown in FIG. 4, in the thermal head X1, a height Ha of the first protrusion 2 from the substrate 7 is configured to be greater than a height Hb of the second protrusion 4 from the substrate 7. Accordingly, great stress F4 may occur from the recording medium P, on the second protrusion 4 positioned on the heat-generating section 9 side with respect to the first protrusion 2, but by setting the height Hb of the second protrusion 4 to be smaller than the height Ha of the first protrusion 2, it is possible to reduce excessive stress F4 occurring on the second protrusion 4. The height Ha of the first protrusion 2 from the substrate 7 can be set to be 35 to 45 μm, and the height Hb of the second protrusion 4 from the substrate 7 can be set to be 20 to 30 μm. It is preferable that the height Hb of the second protrusion 4 from the substrate 7 is 0.4 to 0.8 times the height Ha of the first protrusion 2 from the substrate 7. The height Ha of the first protrusion 2 from the substrate 7 and the height Hb of the second protrusion 4 from the substrate 7 may be suitably set in accordance with the size of the thermal head X1 and the recording medium P. The height Hb of the second protrusion 4 from the substrate 7 is a height of the end 16 from the substrate 7.

The end 16 on the first coating layer 27*a* is disposed on the swollen portion 13*b* of the heat storage layer 13, in a plan view. Accordingly, it is possible to set a protrusion height of the second protrusion 4 and a protrusion height of the swollen portion 13*b* to the height Ha of the second protrusion 4 from the substrate 7. In addition, it is possible to easily increase the height Ha of the second protrusion 4 from the substrate 7.

In the thermal head X1, a length Wa between the first coating layer 27*a* and the heat-generating section 9 is configured to be smaller than a length Wb between the second coating layer 27*b* and the heat-generating section 9. The distance between the first coating layer 27*a* and the heat-generating section 9 indicates a distance from the edge of the heat-generating section 9 to the first coating layer 27*a* in a plan view. The distance between the second coating layer 27*b* and the heat-generating section 9 indicates a distance from the edge of the heat-generating section 9 to the second coating layer 27*b* in a plan view.

As described above, since the length Wa between the first coating layer 27*a* disposed downstream in the transportation direction S and the heat-generating section 9 is smaller than the length Wb between the second coating layer 27*b* disposed upstream in the transportation direction S and the heat-generating section 9, it is possible to increase the force occurring due to reaction F2' from the first protrusion 2 provided on the first coating layer 27*a* disposed downstream in the transportation direction S and the force occurring due to reaction F4' from the second protrusion 4, and it is possible to efficiently release the recording medium P from the first coating layer 27*a*. At that time, the first protrusion 2 and the second protrusion 4 function as guiding sections.

In the thermal head X1, a height Hc of the protection layer 25 positioned on the heat-generating section 9 from the substrate 7 is greater than the height Hb of the second protrusion 4 from the substrate 7 and is smaller than the height Ha of the first protrusion 2 from the substrate 7. Accordingly, it is possible to allow the first protrusion 2 distant from the heat-generating section 9 to function as a guiding section of the recording medium P, and it is possible to allow the second protrusion 4 disposed on the heat-generating section 9 side with respect to the first protrusion 2 to function as a stress release section. As a result, it is possible to efficiently transport the recording medium P and to release the stress F2 occurring on the first protrusion 2.

For the first protrusion 2 and the second protrusion 4, the first coating layer 27*a* can be formed of the resin described above having great viscosity. After forming the first coating layer 27*a* to have an even thickness, a material for forming the first coating layer 27*a* is further applied in the positions for forming the first protrusion 2 and the second protrusion 4, and accordingly, the first protrusion 2 and the second protrusion 4 can be provided.

The example in which one second protrusion 4 is provided on the first coating layer 27*a* is shown, but the embodiment is not limited thereto. Two or more second protrusions 4 may be provided. In this case, the plurality of second protrusions 4 function as stress release sections. Even in a case of providing the first protrusion 2 and the second protrusion 4 on the second coating layer 27*b*, the first protrusion 2 and the second protrusion 4 may be formed with the same method.

As the recording medium P, thermal paper or image receiving paper to be printed by using heat can be exemplified. In the specification, in a case of performing the printing on the medium through an ink ribbon which sublimates when receiving heat, the ink ribbon and the medium are collectively referred to as the recording medium P.

Figure 9:
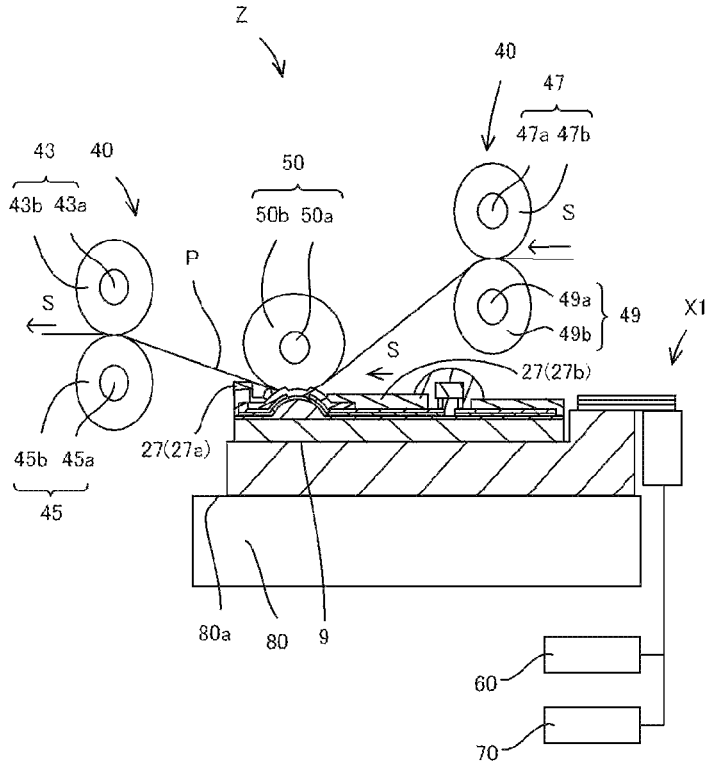
FIG. 9 is a schematic view showing a schematic configuration of one embodiment of a thermal printer of the invention.

Next, one embodiment of a thermal printer of the invention will be described with reference to FIG. 9. FIG. 9 shows an enlarged view of the thermal head X1 for easy understanding. As shown in FIG. 9, a thermal printer Z of the embodiment includes the thermal head X1 described above, a transportation mechanism 40, a platen roller 50, a power device 60, and a control device 70. The thermal head X1 is attached to an attachment surface 80*a* of an attachment member 80 provided in a housing (not shown) of the thermal printer Z. The thermal head X1 is attached to the attachment member 80 so that the arrangement direction of the heat-generating section 9 is a direction orthogonal to the transportation direction S of the recording medium P which will be described later. As described above, the first coating layer 27*a* is provided downstream in the transportation directions of the recording medium P.

The transportation mechanism 40, which is intended to transport the recording medium P such as thermal paper or image receiving paper to which ink is transferred, onto the plurality of heat-generating sections 9 of the thermal head X1 in an arrow S direction of FIG. 9, includes transportation rollers 43, 45, 47, and 49. The transportation rollers 43, 45, 47, and 49, for example, can be configured by coating cylindrical shafts 43*a*, 45*a*, 47*a*, and 49*a* made of metal such as stainless steel with elastic members 43*b*, 45*b*, 47*b*, and 49*b* made of butadiene rubber. Although not shown, in a case where the recording medium P is the image receiving paper to which ink is transferred, the recording medium P and the ink film are transported between the recording medium P and the heat-generating section 9 of the thermal head X1.

The platen roller 50, which is intended to press the recording medium P onto the heat-generating section 9 of the thermal head X1, is disposed so as to extend along a direction perpendicular to the transportation direction S, and is supported, at its ends, so that it is able to rotate while pressing the recording medium P onto the heat-generating section 9. For example, the platen roller 50 can be constructed of a cylindrical shaft body 50*a* made of metal such as stainless steel covered with an elastic member 50*b* made of butadiene rubber or the like.

The power-supply device 60 is intended to supply electric current for causing the heat-generating sections 9 of the thermal head X1 to generate heat as above described, and also electric current for operating the driving IC 11. The control device 70 is intended to supply control signals for controlling the operation of the driving IC 11 to the driving IC 11 in order to cause the heat-generating sections 9 of the thermal head X1 to generate heat in a selective manner as above described.

In the thermal printer Z of the present embodiment, as shown in FIG. 9, the recording medium P is conveyed, while being pressed onto the heat-generating sections 9 of the thermal head X1 by the platen roller 50, onto the heat-generating sections 9 by the conveyance mechanism 40, and simultaneously the heat-generating sections 9 are caused to generate heat in a selective manner by the power-supply device 60 and the control device 70, whereby predetermined printing can be performed on the recording medium P. In the case of using image-receiving paper or the like as the recording medium P, printing can be performed on the recording medium P by thermally transferring the ink of an ink film (not shown) being conveyed together with the recording medium P to the recording medium P.

Second Embodiment

Figure 10:
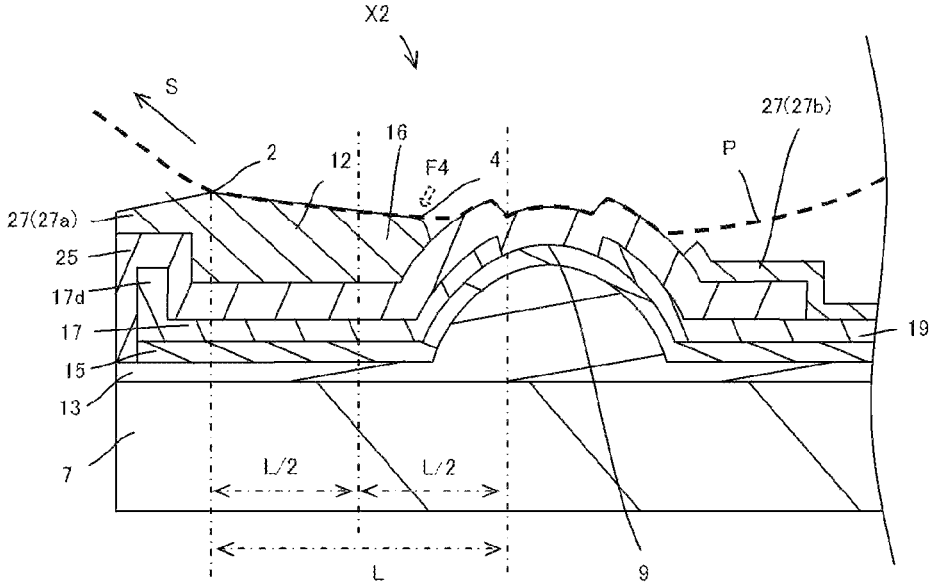
FIG. 10 is an enlarged cross-sectional view according to another embodiment of a thermal head of the invention.

A thermal head X2 will be described with reference to FIG. 10. FIG. 10 shows the recording medium P with a dotted line. In the thermal head X2, the end 16 of the first coating layer 27*a* is formed by an inclined portion 12, an upper surface of which is an inclined side. In addition, a dashed-dotted line is drawn downwards to show the first protrusion 2 clearly. The thermal head X2 is different from the thermal head X1 in a point that the inclined portion 12 is provided, and the other points are same. The same reference numerals refer to the same members as those of the thermal head X1, and those are assumed to be the same members.

In the thermal head X2, the upper surface of the inclined portion 12 is an inclined surface which is inclined from the first protrusion 2 towards the second protrusion 4 provided on the heat-generating section 9 side. The inclined portion 12 is inclined downwards gradually to the second protrusion 4. Accordingly, the first protrusion 2 and the second protrusion 4 gradually connect to each other, and a recess in which the platen roller (not shown) infiltrates is not formed between the first protrusion 2 and the second protrusion 4. Therefore, it is possible to reduce a possibility of generation of print scratches or blurring generated due to the platen roller infiltrating therein. In addition, since the recess is not formed between the first protrusion 2 and the second protrusion 4, it is possible to reduce dirt or dust attached to the recording medium P attaching between the first protrusion 2 and the second protrusion 4.

Further, since the inclined surface which is the upper surface of the inclined portion 12 also comes in contact with the recording medium P, it is possible to release the stress F2 occurring on the first protrusion 2 and the stress F4 occurring on the second protrusion 4, and it is possible to reduce a possibility of damage to the first protrusion 2 and the second protrusion 4.

The inclined portion 12 can be formed by forming the first protrusion 2 and the second protrusion 4, and then applying and curing the same material as the coating layer 27. The inclined portion 12 may be provided at the same time as the first protrusion 2 and the second protrusion 4.

The example in which the inclined portion 12 which is inclined downwards from the first protrusion 2 to the second protrusion 4 is provided on the end 16 of the first coating layer 27*a* is shown, but there is no limitation thereto. For example, the inclined portion 12 having a concave-convex form on the inclined surface may be provided so as to fill the portion between the first protrusion 2 and the second protrusion 4. The inclined portion may be provided to have other embodiments, as long as it reduces the stress applied to the first protrusion 2 from the recording medium.

Third Embodiment

Figure 11:
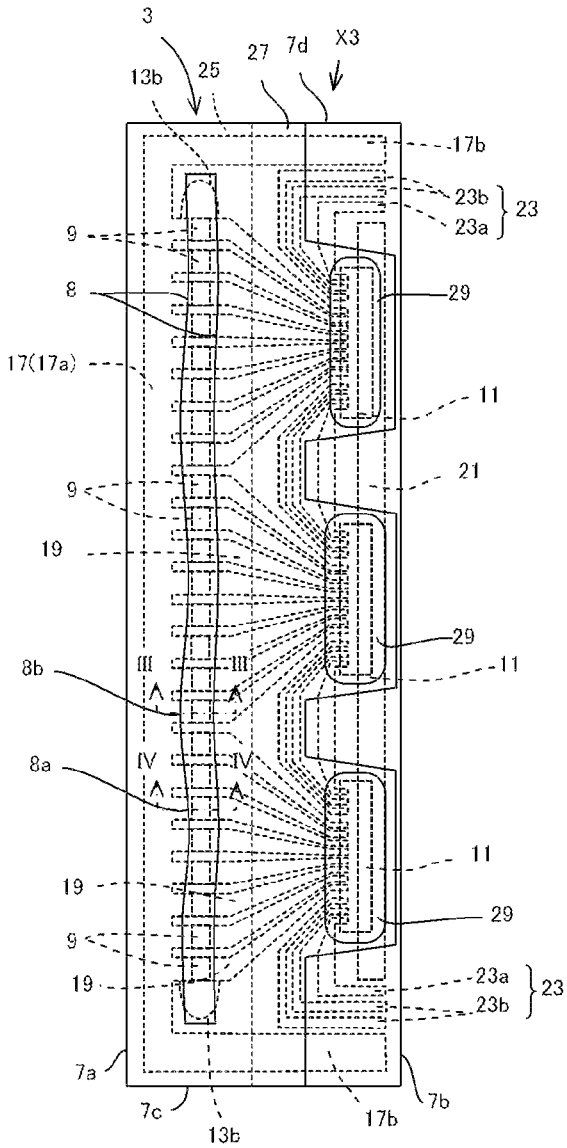
FIG. 11 is a plan view showing still another embodiment of a thermal head of the invention.

A thermal head X3 according to a third embodiment will be described with reference to FIGS. 11 and 12. In the thermal head X3, an end 8 on the heat storage layer 13 side of the first coating layer 27*a* and the end 8 on the heat storage layer 13 side of the second coating layer 27*b* are shaped in a wave form in a plan view. That is, the end 8 on the heat storage layer 13 side of the first coating layer 27*a* and the end 8 on the heat storage layer 13 side of the second coating layer 27*b* are shaped in a concave-convex form in a plan view. The other configurations are the same as those of the thermal head X1, and therefore the description thereof will be omitted.

On the end on the heat storage layer 13 side, the first coating layer 27*a* and the second coating layer 27*b* configuring the thermal head X3 have different distances from the heat-generating section 9 in the arrangement direction of the substrate 7. In detail, an end 8*a* of the first coating layer 27*a* is disposed on the heat storage layer 13 side with respect to an end 8*b* of the first coating layer 27*a*. As shown in FIG. 12, the end 8*a* of the first coating layer 27*a* is disposed on the heat-generating section 9 side with respect to the end 8*b* of the first coating layer 27*a*. Accordingly, the length Wa between the end 8*a* and the protection layer 25 on the heat-generating section 9 is configured to be different from the length Wb between the end 8*b* and the protection layer 25 on the heat-generating section 9.

In a case of performing printing on a hard recording medium such as a card, the printing on the recording medium is performed by interposing the ink ribbon between the recording medium and the thermal head. Herein, when speeding-up of the driving of the thermal head is realized according to high-speed printing, in a case where a release property of the ink ribbon from the thermal head is degraded or in a case where static electricity is generated on the recording medium, blurring may occur on the printed image.

With respect to this, in the thermal head X3, the end 8 on the heat storage layer 13 side of the first coating layer 27*a* and the end 8 on the heat storage layer 13 side of the second coating layer 27*b* are shaped in a concave-convex form in a plan view. Accordingly, it is possible to easily release the ink ribbon R from the first coating layer 27*a* and the second coating layer 27*b* at the time of printing. In detail, when the ink ribbon R is transported onto the first coating layer 27*a*, in the end 8*b* of the first coating layer 27*a* which is the concavity, as shown in FIG. 12(*b*), the ink ribbon R is in a state of partially floating above the end 8*b* of the first coating layer 27*a* which is the concavity. Therefore, even when the ink ribbon R is adhered to the first coating layer 27*a* by static electricity, it is possible to easily release the ink ribbon R from the first coating layer 27*a*.

Figure 12:
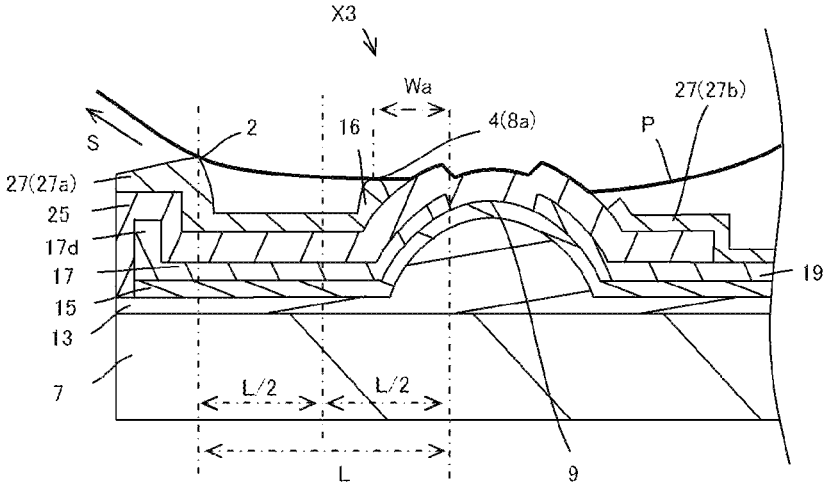
FIG. 12(*a*) is a cross-sectional view taken along the line III-III shown in FIG. 11, and FIG. 12(*b*) is a cross-sectional view taken along the line IV-IV shown in FIG. 11.
Figure 12:
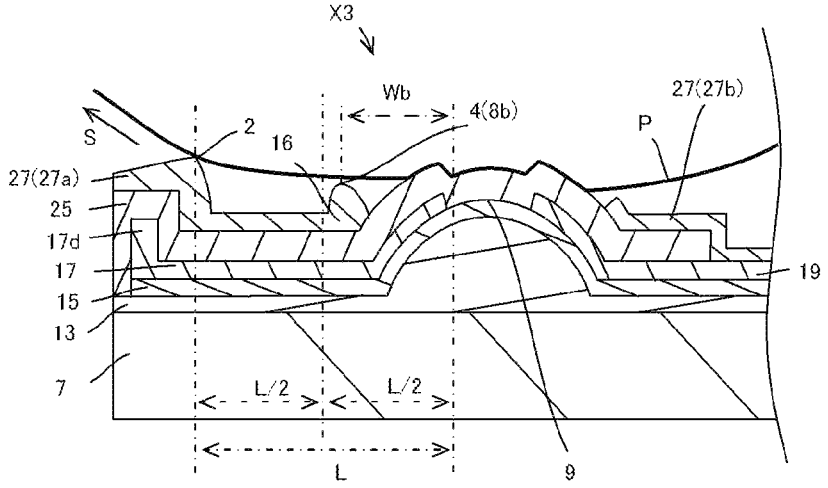

As shown in FIG. 12(*b*), only the first protrusion 2 of the first coating layer 27*a* comes in contact with the ink ribbon R, and the second protrusion 4 which is the end 8*b* of the first coating layer 27*a* does not come in contact with the ink ribbon R, but as shown in FIG. 12(*a*), since the first protrusion 2 of the first coating layer 27*a* and the second protrusion 4 which is the end 8*a* of the first coating layer 27*a* come in contact with the ink ribbon, it is possible to reduce a possibility of damage to the first protrusion 2.

Since the shape of the end 8 on the heat storage layer 13 side of the first coating layer 27*a* and the shape of the end 8 on the heat storage layer 13 side of the second coating layer 27*b* are shaped in a wave form in a plan view, the ink ribbon R disposed in the same position in the transportation direction S is in a state of partially floating above the first coating layer 27*a* and the second coating layer 27*b*, as described above. Accordingly, it is possible to easily release the ink ribbon R from the first coating layer 27*a* and the second coating layer 27*b*. In addition, in a plan view, the wave form indicates that the distance between the end 8 of the coating layer 27 and the heat-generating section 9 is not a constant value and the end 8 of the coating layer 27 is formed to have a continuous curve.

In a case where the end 8 of the coating layer 27 is shaped in the wave form, when a distance between the end 8 of the coating layer 27 and the center of the heat-generating section 9 is set as an average distance W, the end 8 of the coating layer 27 is preferably positioned in a range of ±0.15 mm from the average distance W. Accordingly, it is possible to efficiently perform the release of the thermal head X3 from the ink ribbon R. The wave form thereof is formed by suitably adjusting a printing step when forming the coating layer 27 or viscosity of a resin for forming the coating layer 27.

As an example where the end 8 of the coating layer 27 is shaped in a concave-convex form in a plan view, the example where the end 8 of the coating layer 27 is shaped in the wave form is shown, but there is no limitation thereto. For example, the concave-convex form of the end 8 of the coating layer 27 may be shaped in a stepwise manner, to define a stepwise form.

In addition, the example in which the end of the first coating layer 27*a* and the end of the second coating layer 27*b* are shaped in the concave-convex form in a plan view, is shown, but there is no limitation thereto. Either the end of the first coating layer 27*a* or the end of the second coating layer 27*b* may be shaped in the concave-convex form in a plan view. In addition, either the end of the first coating layer 27*a* or the end of the second coating layer 27*b* may be shaped in the wave form in a plan view.

Fourth Embodiment

A thermal head X4 according to a fourth embodiment will be described with reference to FIGS. 13 and 14. In the thermal head X4, the end 8 of the first coating layer 27*a* is shaped in a concave-convex form when seen from the transportation direction S of the recording medium. The other points are the same as those in the thermal head X1, and therefore the description thereof will be omitted.

Figure 13:
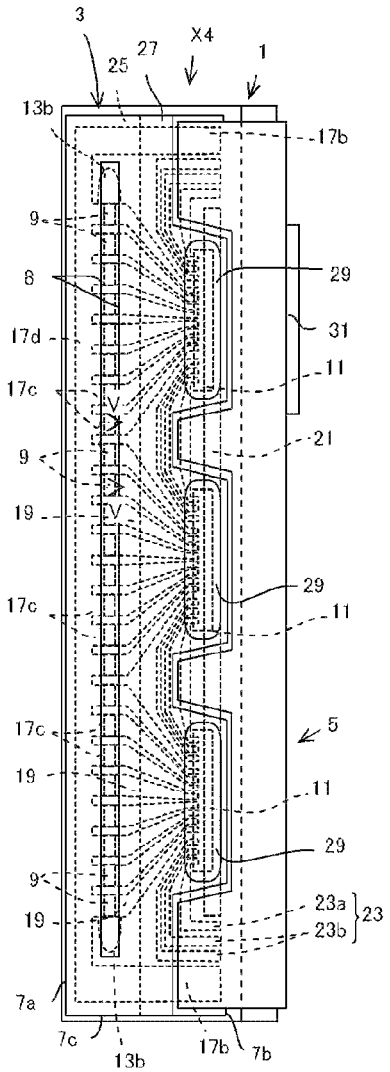
FIG. 13(*a*) is a plan view showing a thermal head according to still another embodiment of the invention, and FIG. 13(*b*) is a cross-sectional view of a thermal head taken along the line V-V in FIG. 13(*a*)
Figure 13:
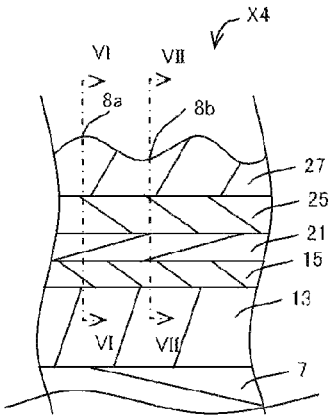

As shown in FIG. 13(*b*), in the thermal head X4, the concave-convex form is provided on the upper surface of the end 8 of the first coating layer 27*a*. That is, the thickness of the first coating layer 27*a* is configured to be different in the arrangement direction. In detail, the thickness of the end 8*a* of the first coating layer 27*a* is configured to be greater than the thickness of the end 8*b* of the first coating layer 27*a*. Since the arrangement direction is a main scanning direction, in the thermal head X4, the end 8 of the first coating layer 27*a* is configured to be shaped in the concave-convex form in the main scanning direction.

Figure 14:
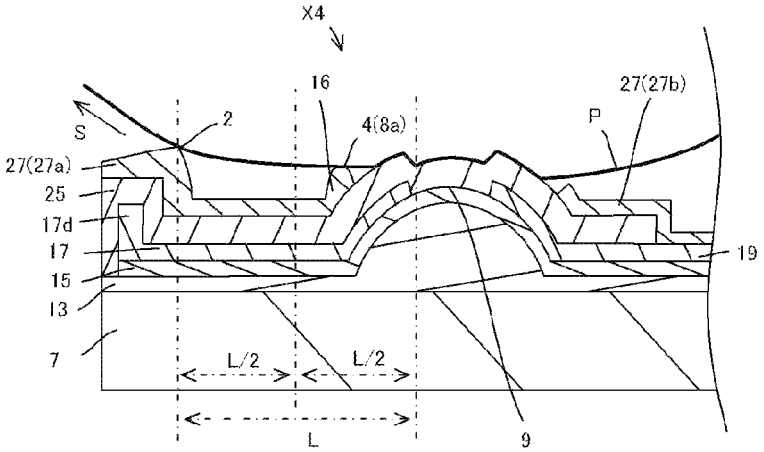
FIG. 14(*a*) is a cross-sectional view of a thermal head taken along the line VI-VI in FIG. 13(*b*), and FIG. 14(*b*) is a cross-sectional view of a thermal head taken along the line VII-VII in FIG. 13(*b*)
Figure 14:
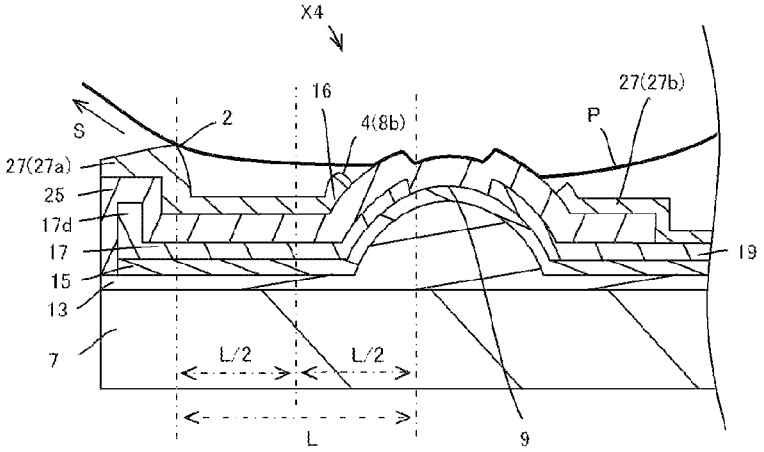

As described above, since the surface of the end 8 of the first coating layer 27*a* is shaped in the concave-convex form in the main scanning direction, as shown in FIG. 14, the second protrusion 4 on the end 8*a* of the first coating layer 27*a* having a greater thickness comes in contact with the ink ribbon R, but the end 8*b* of the first coating layer 27*a* having a smaller thickness does not come in contact with the ink ribbon R. Accordingly, a part where the ink ribbon R does not come in contact with the end 8 of the first coating layer 27*a* is generated, and therefore it is possible to easily release the ink ribbon R from the first coating layer 27*a*.

The concave-convex form provided on the surface of the end of the first coating layer 27*a* can be formed by polishing. Alternatively, the concave-convex form can be formed by forming a concave-convex shape using a resin in advance and bonding it to the surface of the end. In addition, a difference in height of the concave-convex form may be 5 to 20 μm.

The example where the concave-convex form is provided on the end 8 of the first coating layer 27*a* in the arrangement direction is shown, but the concave-convex form may be provided only on the second coating layer 27*b* in the arrangement direction. Even in this case, a part where the ink ribbon R does not come in contact with a part of the end 8 of the second coating layer 27*b* in the main scanning direction can be formed, and therefore it is possible to effectively improve the release property of the ink ribbon R from the thermal head X4.

Fifth Embodiment

Figure 15:
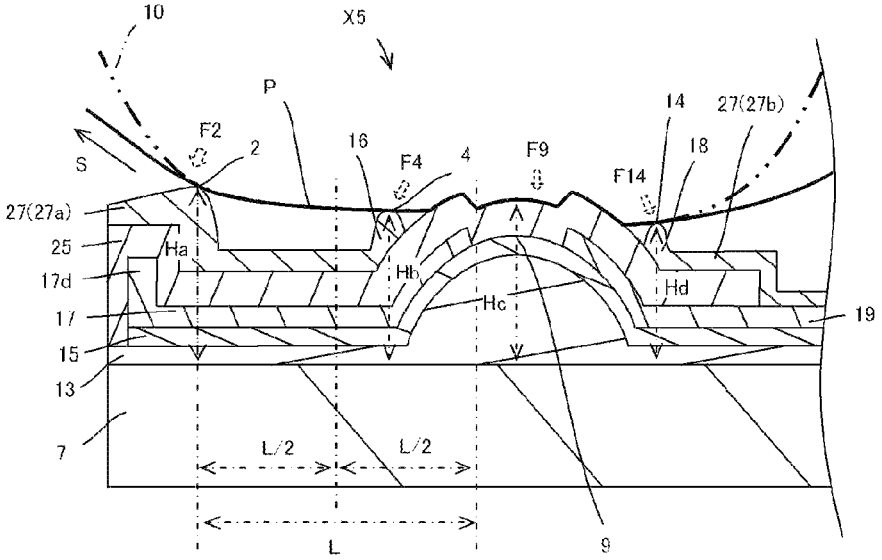
FIG. 15 is an enlarged plan view showing a thermal head according to still another embodiment of the invention.

A thermal head X5 will be described with reference to FIG. 15. In the thermal head X5, the second coating layer 27*b* is disposed downstream in the transportation direction with respect to the heat-generating section 9. An end 18 of the second coating layer 27*b* is a third protrusion 14. The other configurations are the same as those in the thermal head X1.

The second coating layer 27*b* includes the third protrusion 14 on the end on the heat-generating section 9 side. In the thermal head X5, the third protrusion 14 is disposed upstream of the heat-generating section 9. Accordingly, the recording medium P comes in contact with the third protrusion 14 and then comes in contact with the protection layer 25 disposed on the heat-generating section 9. Therefore, the recording medium P is guided to the protection layer 25 disposed on the heat-generating section 9 by the third protrusion 14, and it is possible to efficiently transport the recording medium to the protection layer 25 disposed on the heat-generating section 9. Particularly, in a case of a soft recording medium P such as thermal paper, since the recording medium is guided by the third protrusion 14, it is possible to reduce a possibility of a paper jam in the thermal head X5.

That is, it is possible to reduce a possibility of the platen roller 10 infiltrating between the protection layer 25 on the heat-generating section 9 and the second protrusion 4, and it is possible to reduce a possibility of deformation of the platen roller 10. Accordingly, also on the second protrusion 4 side, it is possible to reduce a possibility of a decrease of the stress F9 occurring on the protection layer 25 on the heat-generating section 9, caused by a force occurring due to reaction F4' which occurs from the second protrusion 4. Therefore, it is possible to reduce a possibility of generation of print scratches in the thermal head X5.

In addition, in the thermal head X5, a height Hd of the third protrusion 14 from the substrate 7 is configured to be smaller than a height Hb of the second protrusion 4 from the substrate 7. Accordingly, it is possible to have the greater stress F4 occurring by the second protrusion 4, compared to the stress F14 occurring by the third protrusion 14. As a result, it is possible to efficiently guide the recording medium to the protection layer 25 disposed on the heat-generating section 9 by the third protrusion 14 on the upstream side of the transportation direction S, it is possible to have the greater force occurring due to reaction F4' which occurs from the second protrusion 4, on the downstream side of the transportation direction S, and it is possible to efficiently release the recording medium P from the protection layer 25.

A relationship among the height Ha of the first protrusion 2 from the substrate 7, the height Hb of the second protrusion 4 from the substrate 7, the height Hd of the third protrusion 14 from the substrate 7, and the height Hc of the protection layer 25 positioned on the heat-generating section 9 from the substrate 7, preferably satisfies a relationship of Ha>Hc>Hb>Hd. Accordingly, it is possible to optimize stress F2, F4, F9 and F14 occurring on the recording medium P, and forces occurring due to reaction F2', F4', F9' and F14'.

Hereinabove, one embodiment of the invention has been described, but the invention is not limited to the embodiments described above, and various modifications is possible without departing from the scope of the invention. The example where the thermal head X1 is used in the thermal printer Z is shown, but any of the thermal heads X2 to X5 may be used. In addition, the thermal heads X1 to X5 according to the plurality of embodiments may be used in combination.

For example, the example of a flat head where the swollen portion 13*b* of the heat storage layer 13 is provided on the main surface of the substrate 7 and the heat-generating section 9 is formed on the main surface of the substrate 7 is shown, but there is no limitation thereto. For example, the invention may be applied to an edge head including the heat storage layer 13 provided on an edge of the substrate and the heat-generating section 9 provided on the heat storage layer 13. Even in this case, it is possible to obtain the same effects as in the invention. In the thermal head provided with the heat-generating section 9 on the edge, the plan view means an edge view. That is, in the specification, the plan view means the plan view of the heat-generating section 9.

In addition, in the thermal head X1 of the embodiments, for example, the heat storage layer 13 includes the swollen portion, which is partially swollen on the substrate 7, formed by providing, on the base layer 13*a*, the swollen portion 13*b* which is partially swollen from the base layer 13*a*, but the configuration of the heat storage layer 13 is not limited thereto. For example, the heat storage layer 13 may be configured only with the swollen portion 13*b* without providing the base portion 13*a*.

In addition, the example where the FPC 5 is used as the external substrate is shown, but there is no limitation thereto. Instead of the FPC 5, a glass epoxy substrate which is a hard rigid substrate may be used or the connector 31 may be directly mounted on the substrate 7. In addition, the example of a thin-film head in which the heat-generating section 9 is formed by a thin film formation technology, is shown, but there is no limitation thereto. A thick-film head in which the heat-generating section 9 is formed by a thick film formation technology may be used.

REFERENCE SIGNS LIST

X1 to X5, X101: Thermal head
Z1: Thermal printer
P: Recording medium
1: Radiator
2: First protrusion
3: Head base body
4: Second protrusion
7: Substrate
8, 16: End of first coating layer
9: Heat-generating section
10: Platen roller
12: Inclined portion
13: Heat storage layer
13*b*: Swollen portion
14: Third protrusion
15: Electrical resistance layer
17: Common electrode
19: Individual electrode
25: Protection layer
27: Coating layer
27*a*: First coating layer
27*b*: Second coating layer

The invention claimed is:

1. A thermal head, comprising:
a substrate;
a heat storage layer disposed on the substrate;
a heat-generating section disposed on the heat storage layer;
an electrode electrically connected to the heat-generating section;
a protection layer which coats the heat-generating section and a part of the electrode; and
a first coating layer which coats a part of the protection layer and is disposed downstream in a transportation direction of a recording medium, with respect to the heat-generating section,
the first coating layer comprising a first protrusion protruding towards a recording medium side,
an end on a heat-generating section side of the first coating layer being positioned between the first protrusion and the heat-generating section, and
the end on the heat-generating section side of the first coating layer being positioned in a range of L/2 from the heat-generating section, in which L is a distance between the heat-generating section and the first protrusion.

2. The thermal head according to claim 1,
wherein the first coating layer comprises a second protrusion protruding towards the recording medium side on the end on the heat-generating section side of the first coating layer, and
a height of the second protrusion from the substrate is smaller than a height of the first protrusion from the substrate.

3. The thermal head according to claim 2,
wherein a height of the protection layer positioned on the heat-generating section from the substrate is greater than the height of the second protrusion from the substrate and is smaller than the height of the first protrusion from the substrate.

4. The thermal head according to claim 2,
wherein the electrode comprises a thick portion having a greater thickness than the other portion of the electrode, and
the first protrusion is provided on the thick portion.

5. The thermal head according to claim 1,
wherein a surface roughness of the first protrusion is larger than a surface roughness of the end on the heat-generating section side of the first coating layer.

6. The thermal head according to claim 1, further comprising:
a second coating layer which coats a part of the electrode, and is disposed upstream in the transportation direction of the recording medium with respect to the heat-generating section,
wherein the second coating layer comprises a third protrusion protruding towards the recording medium side.

7. The thermal head according to claim 6,
wherein a height of the third protrusion from the substrate is smaller than a height of the end on the heat-generating section side of the first coating layer from the substrate.

8. The thermal head according to claim 6,
wherein a length from the end on the heat-generating section side of the first coating layer to the heat-generating section is smaller than a length from the third protrusion to the heat-generating section, in a plan view.

9. The thermal head according to claim 6,
wherein at least one of an upper surface of the end on the heat-generating section side of the first coating layer and an upper surface of an end on the heat-generating section side of the second coating layer is shaped in a concave-convex form.

10. The thermal head according to claim 6,
wherein at least one of the end on the heat-generating section side of the first coating layer and an end on the heat-generating section side of the second coating layer is shaped in a concave-convex form in a plan view.

11. The thermal head according to claim 10,
wherein at least one of the end on the heat-generating section side of the first coating layer and the end on the heat-generating section side of the second coating layer is shaped in a wave form in a plan view.

12. A thermal printer, comprising:
the thermal head according to claim 1;
a transportation mechanism which transports the recording medium onto the heat-generating section; and
a platen roller which presses the recording medium against the heat-generating section.

13. A thermal head, comprising:
a substrate;
a heat storage layer disposed on the substrate;
a heat-generating section disposed on the heat storage layer;
an electrode electrically connected to the heat-generating section;
a protection layer which coats the heat-generating section and a part of the electrode; and
a first coating layer which coats a part of the protection layer and is disposed downstream in a transportation direction of a recording medium, with respect to the heat-generating section,
the first coating layer comprising:
a first protrusion protruding towards a recording medium side, and
a second protrusion protruding towards the recording medium side on the end on the heat-generating section side of the first coating layer, wherein a height of the second protrusion from the substrate is smaller than a height of the first protrusion from the substrate.

14. The thermal head according to claim 13, wherein a height of the protection layer positioned on the heat-generating section from the substrate is greater than the height of the second protrusion from the substrate and is smaller than the height of the first protrusion from the substrate.

15. A thermal printer, comprising:

the thermal head according to claim 13;

a transportation mechanism which transports the recording medium onto the heat-generating section; and a platen roller which presses the recording medium against the heat-generating section.

16. A thermal head, comprising:

a substrate;

a heat storage layer disposed on the substrate;

a heat-generating section disposed on the heat storage layer;

an electrode electrically connected to the heat-generating section;

a protection layer which coats the heat-generating section and a part of the electrode;

a first coating layer which coats a part of the protection layer and is disposed downstream in a transportation direction of a recording medium, with respect to the heat-generating section; and a second coating layer which coats a part of the electrode, and is disposed upstream in the transportation direction of the recording medium with respect to the heat-generating section, wherein the first coating layer comprising a first protrusion protruding towards a recording medium side and an end on a heat-generating section side, wherein the second coating layer comprises a second protrusion protruding towards the recording medium side.

17. The thermal head according to claim 16, wherein a height of the second protrusion from the substrate is smaller than a height of the end on the heat-generating section side of the first coating layer from the substrate.

18. The thermal head according to claim 16, wherein a length from the end on the heat-generating section side of the first coating layer to the heat-generating section is smaller than a length from the second protrusion to the heat-generating section, in a plan view.

19. The thermal head according to claim 16, wherein at least one of an upper surface of the end on the heat-generating section side of the first coating layer and an upper surface of an end on the heat-generating section side of the second coating layer is shaped in a concave-convex form.

20. A thermal printer, comprising:

the thermal head according to claim 16;

a transportation mechanism which transports the recording medium onto the heat-generating section; and a platen roller which presses the recording medium against the heat-generating section.

* * * * *